US005335715A

United States Patent [19]

Ohguro et al.

[11] Patent Number: 5,335,715

[45] Date of Patent: Aug. 9, 1994

[54] METHOD AND APPARATUS FOR CONTINUOUS CASTING

[75] Inventors: Haruo Ohguro; Toshihiro Kosuge; Ryuuzou Hanzawa; Shogo Matsumura; Hiroyuki Kawai; Youji Ao; Tsutomu Fujii, all of Hikari; Hideo Kaneko; Hatsuyoshi Kumashiro, both of Kobe, all of Japan

[73] Assignees: Nippon Steel Corporation, Tokyo; Kawasaki Jukogyo Kabushiki Kaisha, Kobe, both of Japan

[21] Appl. No.: 742,422

[22] Filed: Aug. 8, 1991

[30] Foreign Application Priority Data

| | | | |
|---|---|---|---|
| Aug. 9, 1990 | [JP] | Japan | 2-209298 |
| Aug. 9, 1990 | [JP] | Japan | 2-209299 |
| Jan. 11, 1991 | [JP] | Japan | 3-012560 |
| Apr. 10, 1991 | [JP] | Japan | 3-077690 |
| Apr. 10, 1991 | [JP] | Japan | 3-077691 |
| Jun. 7, 1991 | [JP] | Japan | 3-051409 |

[51] Int. Cl.[5] ..... B22D 11/00

[52] U.S. Cl. ..... 164/475; 164/490

[58] Field of Search ..... 164/490, 440, 475, 415

[56] References Cited

U.S. PATENT DOCUMENTS

| | | | |
|---|---|---|---|
| 3,630,266 | 12/1971 | Watts | 164/490 |
| 3,726,333 | 4/1973 | Goodrich | 164/490 |
| 3,730,251 | 5/1973 | Webbere | 164/490 |
| 3,987,840 | 10/1976 | Birat | 164/490 |
| 4,183,394 | 1/1980 | Viessmann | 164/475 |
| 4,640,335 | 2/1987 | Clark | 164/490 |
| 4,653,571 | 3/1987 | Suzuki | 164/490 |
| 4,817,701 | 4/1989 | Stevens | 164/415 |

FOREIGN PATENT DOCUMENTS

| | | | |
|---|---|---|---|
| 0153014 | 8/1985 | European Pat. Off. . | |
| 0447387 | 9/1991 | European Pat. Off. | 164/475 |
| 6156753 | 3/1986 | Japan | 164/465 |
| 61-71157 | 4/1986 | Japan . | |
| 6427749 | 1/1989 | Japan | 164/475 |
| 64-38136 | 3/1989 | Japan . | |

*Primary Examiner*—P. Austin Bradley
*Assistant Examiner*—Rex E. Pelto
*Attorney, Agent, or Firm*—Wenderoth, Lind & Ponack

[57] ABSTRACT

A continuous cast method comprises continuously supplying molten metal from a tundish through a break ring to a cooled mold having an inlet and an outlet. A cast section is formed by continuously cooling the molten metal in the mold and starting the solidification of the molten metal below its surface and intermittently withdrawing the cast section with respect to the mold through its outlet. During continuous casting, a sealing gas having a pressure higher than atmospheric and soluble in the molten metal is constantly supplied to the entirety of the contact area of the mold and the break ring.

7 Claims, 8 Drawing Sheets

METHOD AND APPARATUS FOR CONTINUOUS CASTING

BACKGROUND OF THE INVENTION

1. Field of the Invention

This invention relates to a method and apparatus for continuous casting and more particularly to a method and apparatus for continuous casting in which molten metal is continuously fed into a cooled cylindrical mold where a cast section is formed by allowing the molten metal to start solidification below the surface thereof and the formed cast section is then withdrawn from the mold.

The method and apparatus of this invention are applicable to the continuous casting of billets and other shapes of carbon steels, stainless steels and other metals.

2. Description of the Prior Art

Horizontal continuous casting is one of the known processes that solidifies molten metal continuously fed to a cooled cylindrical mold below the surface of the molten metal. In horizontal continuous casting, a break ring provided at the inlet of the mold stabilizes the start of metal solidification. The break ring has a circumferential step protruding into the mold whose inside diameter is larger than that of the step. To keep the break ring in close contact with the mold, for example, their mating surfaces are tapered and pressed against each other.

Solidification of the molten metal in the mold starts in a region close to the periphery of the forward end of the break ring (which is a downstream portion of the metal stream), with the solidified shell growing while being intermittently withdrawn through the exit end of the mold.

Gas bubbles often form in a subsurface portion of the sections cast by the above method. There are several reasons for this. Even when the break ring is pressed against the mold as described above, for example, a gap can result from thermal expansion or other causes. No air is admitted to near the break ring that allows metal solidification to start below the surface of the molten metal because the ferrostatic pressure of the molten metal at the break ring where solidification starts is higher than atmospheric. When the solidified shell is withdrawn and detached from the forward end of the break ring, however, a nearly evacuated gap forms between the forward end of the break ring and the rear end of the solidified shell (that faces the forward end of the break ring), though only for a short period of time. The air then passes from outside the break ring, through an opening between the mating surfaces of the break ring and the mold, to that gap and further into the molten metal to form gas bubbles. Sometimes, the air admitted from the exit end of the mold passes through the opening between the break ring and the mold to that gap and into the molten metal to form gas bubbles.

The gas bubbles form in a region 2 mm to 3 mm below the surface of the cast section. When subsequently rolled, the gas bubbles in cast sections result in various types of surface defects, such as seams and longitudinal cracks. The defects thus formed are particularly serious with stainless steels and other products that must meet stringent surface quality requirements. Therefore, the gas bubbles must be removed by scarfing or other surface conditioning processes, which, however, add to production costs and lower production yield.

In the Japanese Provisional Utility Model Publication No. 38136 of 1989 is disclosed technology for fitting a break ring in such a manner as to prevent the infiltration of the air. This technology hermetically seals the junction where a break ring and a molten metal cooling segment (a mold) meet with an annular gasket of a heat-resistant material. But the annular gasket deteriorates when it is heated, for example, by the heat from the mold to above the temperature it can withstand. The damaged annular gasket loses its sealing function, with resultant infiltration of the air into the mold and formation of gas bubbles in the solidified shell.

The U.S. Pat. No. 4,817,701 discloses continuous casting technology that seals a molten metal feed nozzle and the inlet of a mold with an inert gas that does not react with molten metal. The object of this technology is to completely prevent the infiltration of gases in the atmosphere that oxidize the surface of molten metal. But this technology too is not quite free of the risk of forming gas bubbles in cast sections.

By analyzing the gas contained in the formed bubbles to determine the cause of their formation, the inventors learned that the gas in the bubbles consisted mainly of argon and the metal surrounding the bubbles showed a higher nitrogen content than elsewhere. From this finding it was presumed that nitrogen in the air dissolved in molten metal, but argon, which is insoluble in molten metal, remained intact as gas bubbles. To confirm this presumption, a continuous casting test was performed by supplying an inert argon gas to inside a shielding means that surrounds the periphery of the break ring as in the technology of the U.S. patent mentioned before. In the test, more gas bubbles were formed in the subsurface region of the cast sections than in the conventional argon-free continuous casting operation. No gas bubbles were formed when nitrogen, which is soluble in molten metal, was supplied in place of insoluble argon. The present invention is based on the finding just described.

Japanese Provisional Patent Publication No. 71157 of 1986 discloses horizontal continuous casting technology using a cylindrical mold in which nitrogen is supplied to a portion of a corner member, which consists of a refractory plate projecting inward from the inner surface of the lindrical mold, that lies below the axis of cylindrical mold. This technology uniformly cools the entire surface of the solidified shell by shifting downstream the point where molten metal comes in contact with the inner surface of the lower portion of the mold. Introducing nitrogen only to the lower portion of the corner member, however, does not prevent the infiltration of the air into the mold through the entire circumference of the junction where the break ring meets the inner surface of the mold.

SUMMARY OF THE INVENTION

The object of this invention is to provide a method and apparatus for continuously casting cast sections of improved quality that prevent the infiltration of argon and other gases insoluble in molten metal and the formation of gas bubbles in the cast section by avoiding the exposure of molten metal to the atmosphere.

The method and apparatus according to this invention avoid the exposure of molten metal to the atmosphere by supplying a sealing gas soluble in molten metal to where air infiltration into the mold is likely to occur. Soluble in molten metal, the sealing gas does not remain in the cast section as gas bubbles. This eliminates the need for removing gas bubbles from cast sections, thereby assuring the production of surface-defect-free good-quality rolled products at low cost.

The method and apparatus of this invention include the operative steps (a) to continuously supply molten metal from a tundish to a cooled mold having an inlet and an outlet at least through a break ring, (b) to form a cast section by continuously cooling the molten metal in the mold so that metal solidification starts below the surface of the molten metal, (c) to withdraw the cast section intermittently with respect to the mold from the outlet of the mold, and (d) to constantly supply a sealing gas soluble in the molten metal at a pressure higher than atmospheric to fill the entirety of a gap between the mating surfaces of the mold and the break ring from outside the mold inlet and/or the entirety of a gap between the mold and the cast section from outside the mold outlet.

A cut-off space bounded by a closed curve whose diameter is larger than the maximum diameter of the mating surfaces of the mold and the break ring may be provided contiguous to the mold inlet. Into this cut-off space is constantly supplied a sealing gas soluble in the molten metal at a pressure higher than atmospheric to cut off the inflow of the air into the mold through the gap between the mating surfaces. The cut-off space may be divided into two diametrically isolated spaces, with an outer cut-off space supplied with the sealing gas and an inner cut-off space kept at a pressure lower than atmospheric. Furthermore, another cut-off space, to which the same sealing gas soluble in the molten metal is constantly supplied at a pressure higher than atmospheric, may be provided on the exit side of the mold, too. One cut-off space may be provided at each of the inlet and outlet ends of the mold, with the one at the inlet end kept at a pressure lower than atmospheric and the one at the exit end supplied with the sealing gas soluble in the molten metal.

DESCRIPTION OF THE PREFERRED EMBODIMENTS

The horizontal continuous caster is one of the continuous casting machines that forms a solidified shell by starting metal solidification below the surface of molten metal in a mold and withdraws a resulting cast section from the mold.

Figure 1:
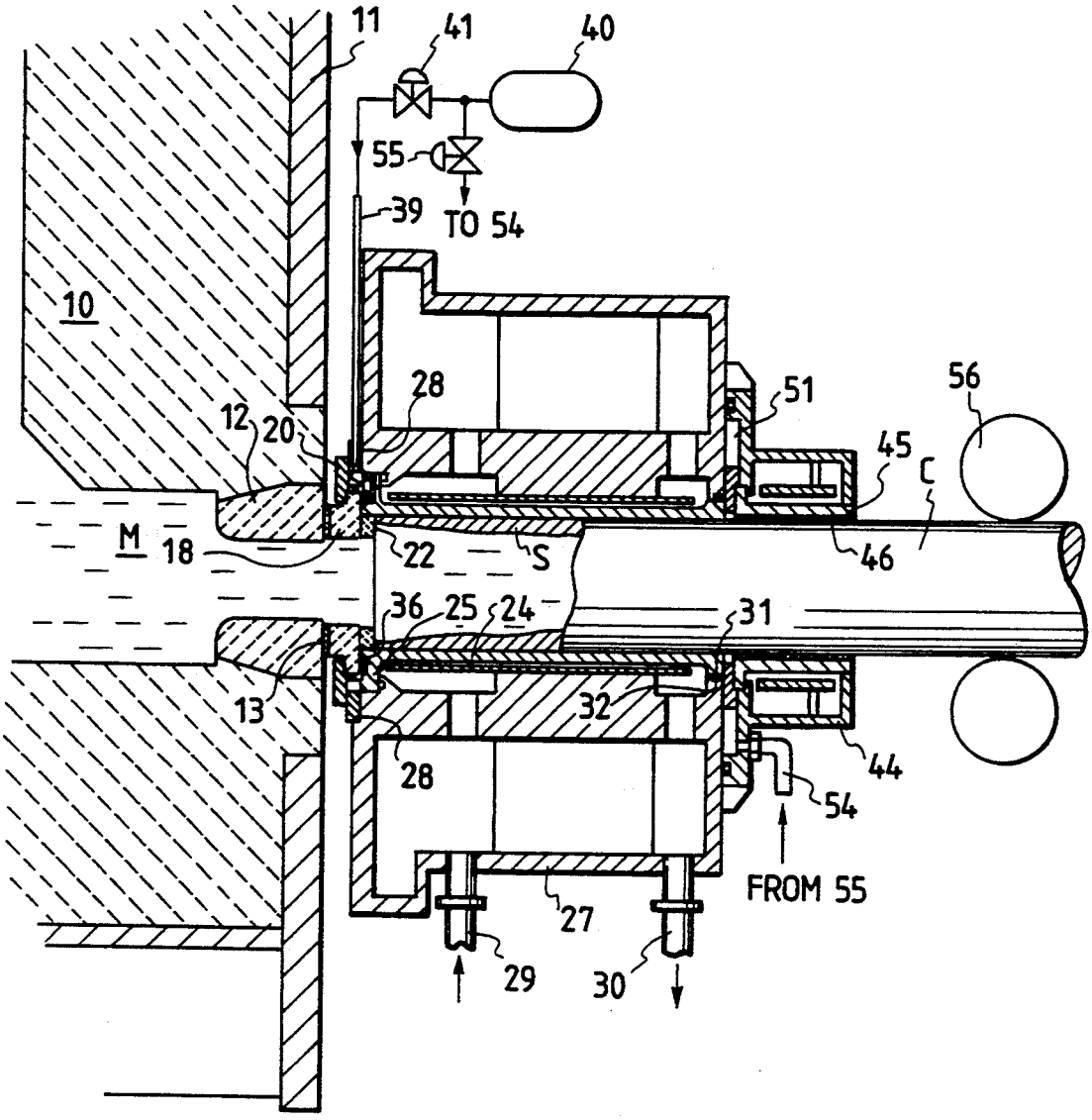
FIG. 1 is a vertical cross-sectional view of a horizontal continuous caster embodying the principle of this invention.

FIG. 1 shows a horizontal continuous round billet caster. As shown in the figure, a tundish nozzle 12 at the bottom of a tundish 10 and a mold 24 communicate with each other through an intermediate ring 18 and a break ring 22. Castable refractory 13 is set between the tundish nozzle 12 and intermediate ring 18. The tundish 10, tundish nozzle 12 and intermediate ring 18 are made of ordinary zircon or alumina refractories. While the break ring 22 is pressed in the inlet of the mold 24, the intermediate ring 18 is fastened to the mold 24 with a metal fastener 20. The break ring 22 is made of heat-resistant ceramics containing boron nitride, silicon nitride, etc. The mold 24 is made of copper and affixed to a housing 27 with a fastening ring 28. To the housing 27 are connected a cooling water feed pipe 29 and a cooling water discharge pipe 30, and cooling water circulated through the housing 27 cools the mold 24. An annular gasket groove 31 is provided at each of the front and rear ends of the housing 27 to hold an annular gasket 32. The annular gasket 32 prevents the leaking of the cooling water from between the mold 24 and housing 27. The intermediate ring 18, break ring 22, mold 24 and housing 27 can be integrally connected to and disconnected from the tundish 10.

Molten metal M is supplied from the tundish 10 to the mold 24 through the tundish nozzle 12, intermediate ring 18 and break ring 22. Cooled by the inner surface of the mold 24, the molten metal M forms a solidified shell S therein. Formation of the solidified shell S starts at the break ring 22. The break ring 22 prevents the solidified shell S from growing in the opposite direction or toward the intermediate ring 18. Cast section C resulting from the solidification of the molten metal M is intermittently withdrawn from the outlet of the mold 24 by means of intermittently rotated pinch rolls 56. The intermittent withdrawal of the cast section C with respect to the mold creates a gap between the break ring 22 and the solidified shell S. Molten metal M flowing into the gap then forms a new solidified shell S. The intermittent withdrawal of the cast section C with respect to the mold 24 may also be achieved by oscillating the mold 24 in the withdrawing direction while continuously rotating the pinch rolls 56.

The air passes to the gap left between the break ring and solidified shell, as described previously, from outside the break ring 22 through a gap between the mating surfaces of the break ring 22 and mold and from outside the mold outlet through a gap between the cast section C and mold 24, forming gas bubbles on being entrapped in the molten metal M. To avoid the admission of the air, the preferred embodiment being described has sealing mechanisms shown in FIGS. 1 to 3.

Figure 2:
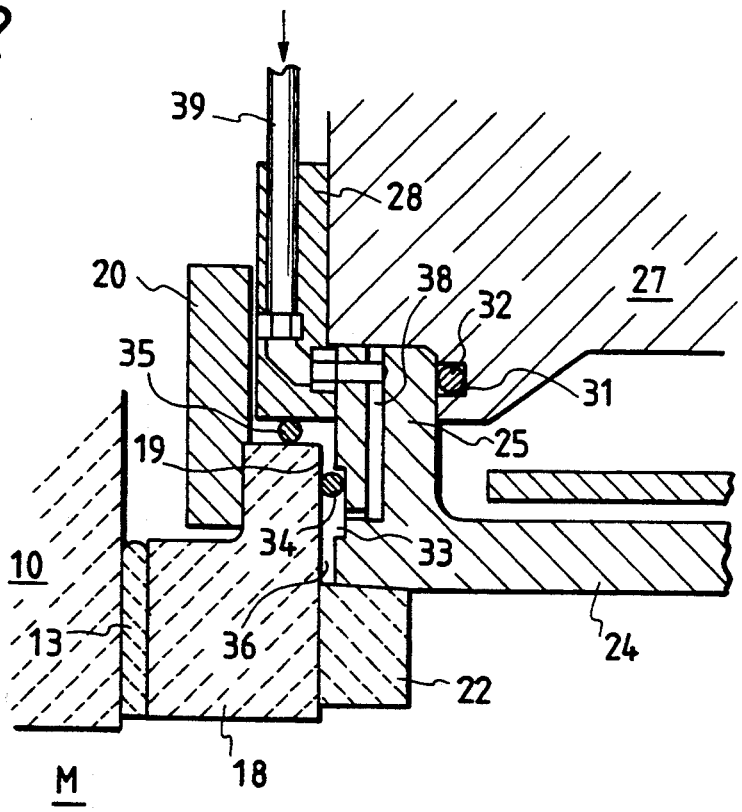
FIG. 2 is a vertical cross-sectional view of a sealing mechanism at the inlet end of a mold shown in FIG. 1.

As shown in FIGS. 1 and 2, an annular gasket groove 33 is cut in the inlet end surface of the mold 24 to receive an annular gasket 34 of silicone rubber (which deteriorates at about 250° C.). Inserted between the flange surface of the intermediate ring 18 and the inlet end surface of the mold 24, the annular gasket 34 forms an annular cut-off space on the outside of the outer surface of the break ring 22. Another annular gasket 35 is inserted between the outer periphery of the intermediate ring 18 and the inner surface of the fastening ring 28 to doubly seal the outside of the break ring 22. This multiple sealing provides a tighter seal.

A seal gas supply passage 38 is provided in the flange 25 of the mold 24. Opening at the annular gasket groove 33, the seal gas supply passage 38 communicates with the cut-off space 36. To the inlet of the seal gas supply passage 38 is connected a seal gas supply pipe 39 that is, in turn, connected to a nitrogen gas cylinder 40 through a pressure regulating valve 41.

Figure 3:
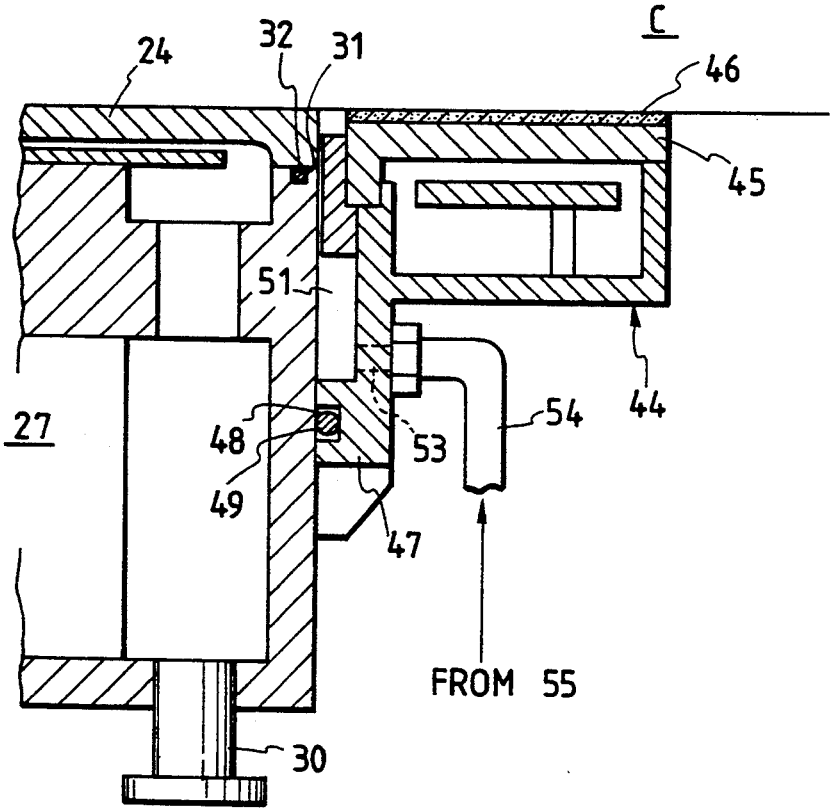
FIG. 3 is a vertical cross-sectional view of a sealing mechanism at the outlet end of a mold shown in FIG. 1.

As shown in FIGS. 1 and 3, an annular seal box 44 is attached to the exit end of the mold 24. The seal box has a sleeve 45 whose inside is lined with graphite 46, and the cast section C passes through the sleeve 45. An annular gasket groove 48 is cut in the surface of a flange 47 of the seal box 44 that faces the exit end surface of the mold 24. With an annular gasket 49 inserted in the annular gasket groove 48, an annular gasket cut-off space 51 surrounding the cast section C is formed inside the flange 47. A seal gas supply passage 53 is provided in the flange 47. Opening on the inner side of the annular gasket groove 48, the seal gas supply passage 53 communicates with the cut-off space 51. To the inlet of the seal gas supply passage 53 is connected a seal gas supply pipe 54 that is, in turn, connected to the nitrogen gas cylinder 40 through a pressure regulating valve 55.

In the sealing mechanism Just described, the pressure regulating valves 41 and 55 supply the nitrogen gas from the nitrogen gas cylinder 40 to the cut-off space 36 between the intermediate ring 18 and mold 24 and the cut-off space 51 in the seal box 44 after lowering the pressure thereof to approximately 5 to 6 kgf/cm$^2$ above the ambient atmospheric pressure. Though the nitrogen gas initially has a pressure higher than atmospheric, as described above, its pressure drops considerably by the time it reaches the break ring 22 in the mold 24 because of the resistance it encounters in its passage. The initial pressure of the nitrogen gas is set so that the gas pressure in the vicinity of the break ring 22 in the mold does not exceed the ferrostatic pressure of the molten metal M. Because the nitrogen gas is kept at a pressure higher than atmospheric in the cut-off spaces 36 and 51, argon in the atmosphere is not admitted into the mold 24. Because, in addition, the pressure of the nitrogen gas in the vicinity of the break ring 22 in the mold 24 is kept below the ferrostatic pressure of the molten metal M, the nitrogen gas does not flow backward and spout out from the tundish 10. Dissolving in the molten metal M, the nitrogen gas does not remain in the cast section C as gas bubbles. Even when some nitrogen gas has escaped into the mold 24, the sleeve 45 or the atmosphere, the cut-off spaces 36 and 51 are always filled with the nitrogen gas automatically made up from the nitrogen gas cylinder 40.

Though nitrogen gas is the most preferable seal gas soluble in molten metal, one or more gases may also be selected from the group of carbon monoxide, carbon dioxide, hydrogen, methane, propane and ammonia.

Figure 4:
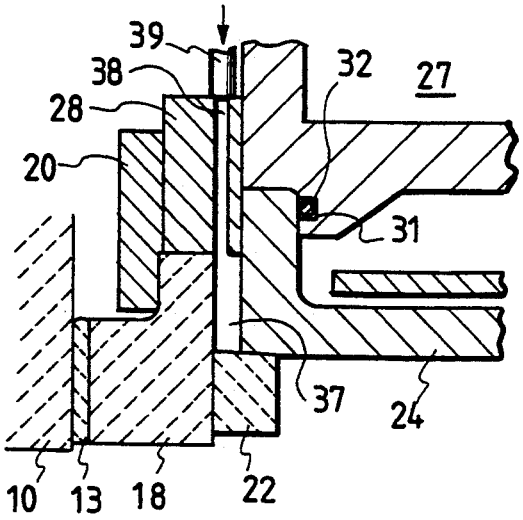
FIG. 4 is a vertical cross-sectional view of another sealing mechanism at the inlet end of a mold shown in FIG. 1.

FIG. 4 shows a simpler example of the sealing mechanism at the inlet end of the mold, which differs from the one shown in FIG. 2 in that no cut-off space is provided. An annular space 37 is formed between the break ring 22 and fastening ring 28, but not sealed by a gasket or other means. In the fastening ring 28 is provided a radially extending seal gas supply passage 38 whose entry end is connected to the seal gas supply pipe 39.. Because the annular space 37 is not completely cut off from the atmosphere, the pressure of the nitrogen gas supplied there is set at approximately 6 to 10 kgf/cm$^2$ above atmospheric, which is higher than the pressure in the sealing mechanism shown in FIG. 2.

A similarly unsealed annular space filled with the high-pressure nitrogen gas may be formed on the exit side of the mold, too.

Figure 7:
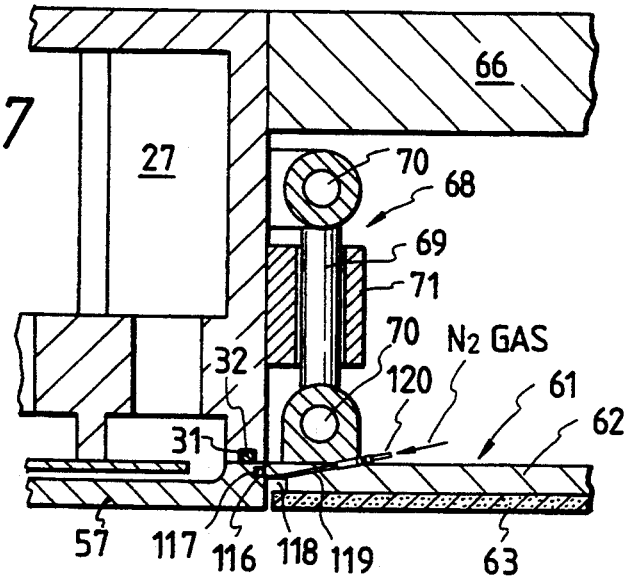
FIG. 7 is a vertical cross-sectional view of a sealing mechanism disposed between two adjoining molds shown in FIG. 5.
Figure 5:
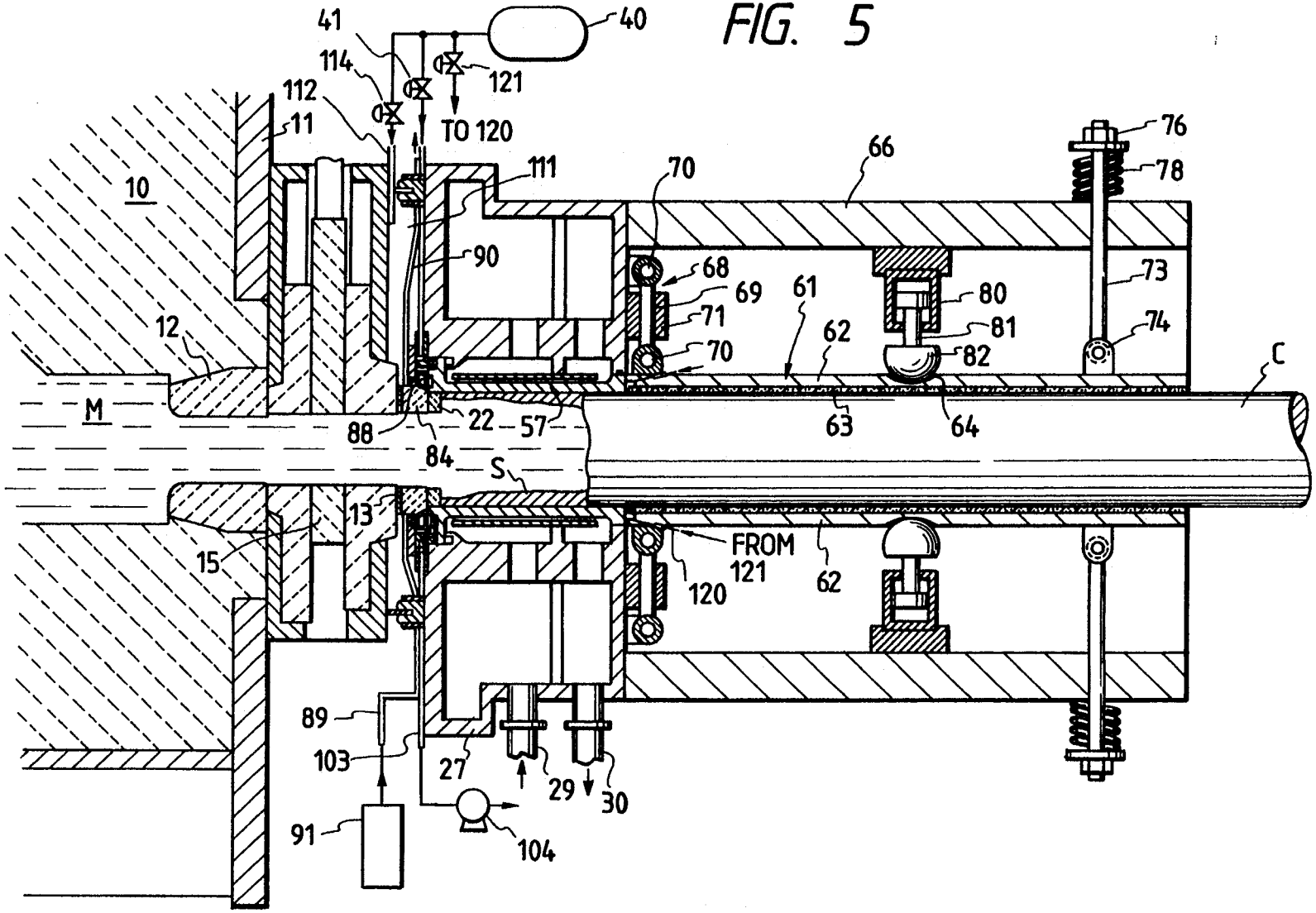
FIG. 5 is a vertical cross-sectional view of another horizontal continuous caster embodying the principle of this invention.
Figure 6:
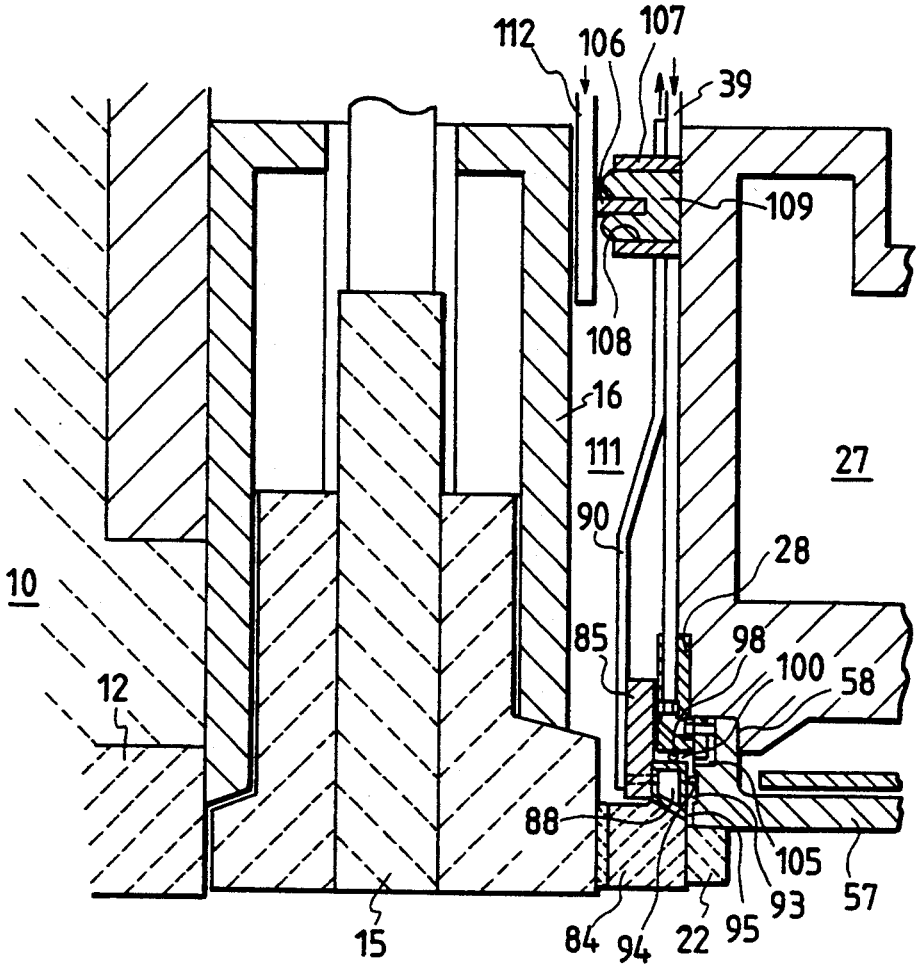
FIG. 6 is a vertical cross-sectional view of a sealing mechanism at the inlet end of a mold shown in FIG. 5.
Figure 6:
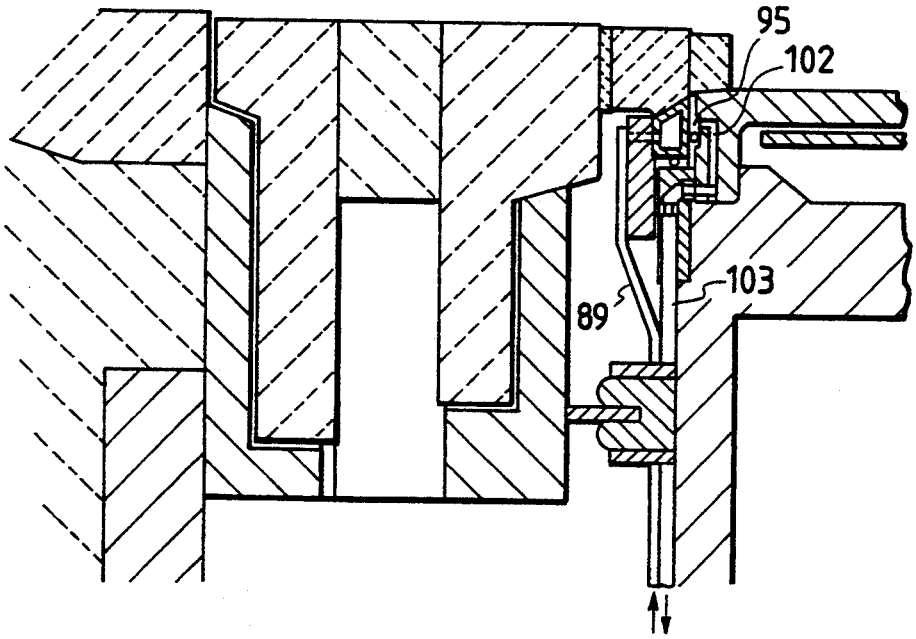

FIGS. 5 to 7 show another preferred embodiment of this invention. In the following description, members similar to those in the preferred embodiment shown in FIG. 1 are designated by similar reference characters, with the detailed description thereof omitted.

A horizontal continuous caster shown in FIG. 5 has a first mold 57 and a second mold 61. A tundish nozzle 12 communicates with the first mold 57 through a sliding gate 15, an intermediate ring 84 and a break ring 22. The sliding gate 15 is made of ordinary zircon- or alumina-refractories, like the tundish 10, etc. The first mold 57 is the same as the mold 24 in the first preferred embodiment described before. A second mold 61 is an adjustable mold consisting of four circumferentially divided quadrantal mold segments 62, with the inside of each segment lined with graphite 63. A holding frame 66, a link mechanism 68 and a guide sleeve 71 are attached to the exit end of the first mold 57. The forward end of each mold segment 62 is connected the link mechanism 69, and a link 68 is guided by the guide sleeve 71. A spring shaft 73 passes through the rear end of the holding frame 66. One end of the spring shaft 73 is connected to each mold segment 62 by a pan 74, with an adjusting nut 76 screwed onto the other end thereof. A coil spring 78 is inserted between the holding frame 66 and the adjusting nut 76. Four hydraulic cylinders 80 are provided in the middle of the holding frame 66, and a hemispherical holder 82 is provided at the tip of a piston rod 81. The holder 82 on the piston rod 81 fits in a shallow spherical recess 64 in each mold segment 62. When pressurized fluid is supplied to the hydraulic cylinder 80, a force to tilt each mold segment 62 about a pin 70 in the link mechanism 68 against the force of the coil spring 78 works on the mold segment 62. The tilting of the mold segment 62 is automatically adjusted depending on the degree to which the cooled cast section C shrinks.

Now the sealing mechanisms are described in the following paragraphs.

First, a sealing mechanism at the entry end of the first mold 57 will be described. As shown in FIGS. 5 and 6, a hollow cooling ring 88 of steel is fitted over the intermediate ring 84 and bonded thereto with cement. The hollow cooling ring 88 is ring-shaped, with a trapezoidal cross section. The inside of the hollow cooling ring 88 is divided by partition walls (not shown). To increase the cooling effect of annular gaskets 94 and 98 and the vicinity thereof, the broader face (front) of the hollow cooling ring 88 faces the entry end of the first mold 57. An inter-mediate ring holder 85 holds down the rear of the hollow cooling ring 88. A cooling air supply pipe 89 and an cooling air discharge pipe 90 are connected to the hollow cooling ring 88. The cooling air supply pipe 89 and cooling air discharge pipe 90 hermetically pass through an annular double wall 107, which will be described later. A cooling unit comprising a compressor, a cooler, a dehumidifier, etc. is connected to the cooling air supply pipe 89. The cooling air supplied from the cooling air supply pipe 89 cools the hollow cooling ring 88 by substantially travelling therearound, and is then discharged into the atmosphere through the cooling air discharge pipe 90.

An annular gasket groove 93 is cut in the entry end surface of the first mold 57 to hold and fit therein the annular gasket 94 of silicone rubber. The annular gasket 94, held between the front end of the hollow cooling ring 88 and the entry end surface of the first mold 57, forms a first annular cut-off space "a" 95 on the outside of the periphery of the break ring 22. The annular gasket 98, inserted between the outer surface of the hollow cooling ring 88 and the inner surface of the fastening ring 28, forms another first annular cut-off space "b" 100 between the annular gasket 94 and the annular gasket 98.

A suction port 102 is provided in the flange 58 of the first mold 57. The suction port 102 opens at the annular gasket groove 93 and communicates with the first cut-off space "a" 95. To the inlet of the suction port 102 is attached a suction pipe 103 that is connected to a vacuum pump 104. A seal gas supply port 105 is also provided in the flange 58 of the first mold 57. The seal gas supply port 105 opens at the first cut-off space 100 "b". To the inlet of the seal gas supply port 105 is connected a seal gas supply pipe 39 that hermetically passes through the annular double wall 107 (described in the following). The nitrogen gas cylinder 40 is connected to the seal gas supply pipe 39 through the pressure regulating valve 41.

A circumferential wall 106 is welded to the front end surface of the frame 16 of the sliding gate 15. The annular double wall 107, of steel plate, is welded to the housing 27 of the first mold 57 facing the frame 16 of the sliding gate 15 to form a gasket groove 108. A gasket 109 of kao wool is inserted in the gasket groove 108. The circumferential wall 106 and the annular double wall 107 form a second annular cut-off space 111 therebetween. A nitrogen gas intake pipe 112 perpendicularly passes through the circumferential wall 106. The nitrogen gas intake pipe 112 is connected to the nitrogen gas cylinder 40 through a pressure regulating valve 114.

When the intermediate ring 84 and the first mold 57 in the sealing mechanism at the entry end of the first mold 57 just described are connected together, the desired amount of sealing surface pressure works on the annular gasket 94 that is compressed between the entry end surface of the first mold 57 and the front end of the hollow cooling ring 88. Driven forward by a hydraulic cylinder (not shown), the tundish 10 is connected to the molds 57 and 61 through the sliding gate 15 and intermediate ring 84. When the front end of the circumferential wall 106 comes in contact with the gasket 109, the inside of the second cut-off space 111 is automatically sealed. This eliminates the need to seal the space between the sliding gate 15 and first mold 57.

When operated, the vacuum pump ]04 expels the residual air from the first cut-off space "a" 95 to keep the pressure therein below atmospheric. Pressurized nitrogen gas is supplied from the nitrogen gas cylinder 40 to the first cut-off space "b" 100 and the second cut-off space 111. Before being supplied, the pressure of the high-pressure nitrogen gas in the nitrogen gas cylinder 40 is reduced to about 5 kgf/cm$^2$ above atmospheric by the pressure regulating valves 41 and 114. Because the pressure of the nitrogen gas is higher than atmospheric, no air flows inside the sliding gate 15, intermediate ring 84 and first mold 57. The nitrogen gas consumed by dissolving it into the cast section C to form a solid solution, or flowing into the sliding gate 15 or elsewhere is automatically made up for from the nitrogen gas cylinder 40.

One sealing surface of the annular gasket 94 is in contact with the hollow cooling ring 88, whereas the other sealing surface is in contact with the entry end surface of the water-cooled first mold 57. Therefore, the annular gasket 94 is kept below the withstandable temperature limit. Accordingly, the annular gasket 94 remains proof against thermal deterioration and, therefore, maintains its original sealing performance. When the actual temperature of the hollow cooling ring 88 was measured, the highest temperature in the vicinity of the annular gasket was approximately 200° C., well below the temperature limit of 230° C. the annular gasket of silicone rubber can withstand.

In the sealing mechanism just described, the circumferential wall 106 and double wall 107 may surround the sliding gate 15, intermediate ring 84 and break ring 22, instead of the intermediate ring 84 and break ring 22. In this arrangement, the circumferential wall 106 is attached to the steel shell 11 of the tundish 10. Also, the circumferential wall 106 may be attached to the housing 27 of the first mold 57, instead of the frame 16 of the sliding gate 15. In this arrangement, the annular gasket 108 is attached to the frame 16 of the sliding gate 15.

Now a sealing mechanism between the first mold 57 and the second mold 61 will be described. As shown in FIGS. 5 and 7, an annular gasket groove 116 is cut in the exit end surface of the first mold 57, and an annular gasket 117 is inserted therein. Also, an annular nitrogen gas supply groove 118 leading into the second mold 61 is cut in the entry end thereof. The entry end surface of the second mold 61 contacting the annular gasket 117 seals the nitrogen gas supply groove 118. A seal gas supply port 119 is provided near the entry end of the second mold 61. The seal gas supply port 119 opens into the nitrogen gas supply groove 118. A seal gas supply pipe 120 is attached to the inlet of the seal gas supply port 119. The seal gas supply pipe 120 is connected to the nitrogen gas cylinder 40 through a pressure regulating valve 121.

In the sealing mechanism just described, the nitrogen gas is supplied from the nitrogen gas cylinder 40 to the nitrogen gas supply groove 118, with the pressure thereof reduced by the pressure regulating valve 121 to about 5 to 6 kgf/cm$^2$ above atmospheric. Because the pressure of the nitrogen gas in the nitrogen gas supply groove 118 is higher than atmospheric, no air flows into the first mold 57 and second mold 61. Even when the nitrogen gas flows into the molds 57 and 61, the nitrogen gas supply groove 118 is always filled with the nitrogen gas, losses being automatically made up for from the nitrogen gas cylinder 40.

Figure 8:
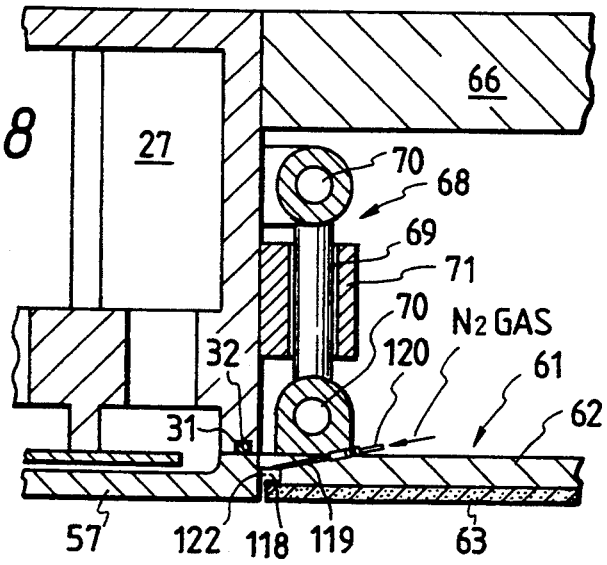
FIG. 8 is a vertical cross-sectional view of another sealing mechanism disposed between two adjoining molds shown in FIG. 5.

FIG. 8 shows a simplified modification of the sealing mechanism between the first mold 57 and second mold 61 shown in FIG. 7. The simplified sealing mechanism differs from the one shown in FIG. 7 in that it has no cut-off space. W While an annular nitrogen gas supply groove 118 is provided in the entry end surface of the second mold 61, an annular space 122 is formed between the first mold 57 and second mold 61. The annular space 122 is not sealed with a gasket or other material. The annular space 122 communicates with a seal gas supply port 119 provided in the mold segment 62, with the seal gas supply pipe 120 connected to the inlet of the seal gas supply port 119. Because the annular space 122 is not completely cut off from the atmosphere, the pressure of the nitrogen gas supplied there is set at a level of about 6 to 10 kgf/cm$^2$ above atmospheric which is higher than in the case of the sealing mechanism shown in FIG. 7.

The second preferred embodiment just described is a round billet caster. Now a square billet caster will be described in the following.

Figure 9:
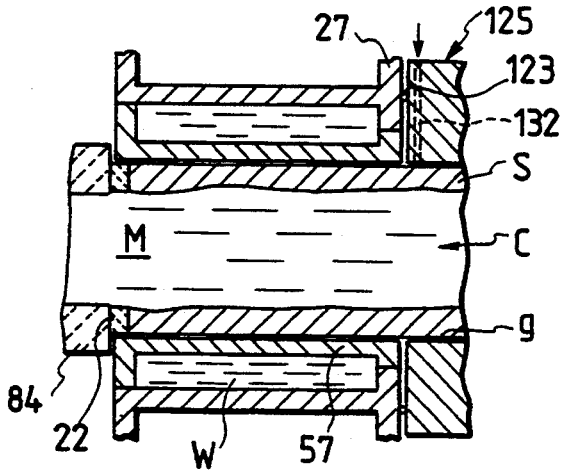
FIG. 9 is a cross-sectional view showing a first mold and surrounding mechanisms of a continuous square billet caster embodying the principle of this invention.

As shown in FIG. 9, an annular gasket 123 of silicone rubber is inserted and held between the housing of the first mold 57 and a second mold 125 in such a manner as to surround the cast section C.

Figure 10:
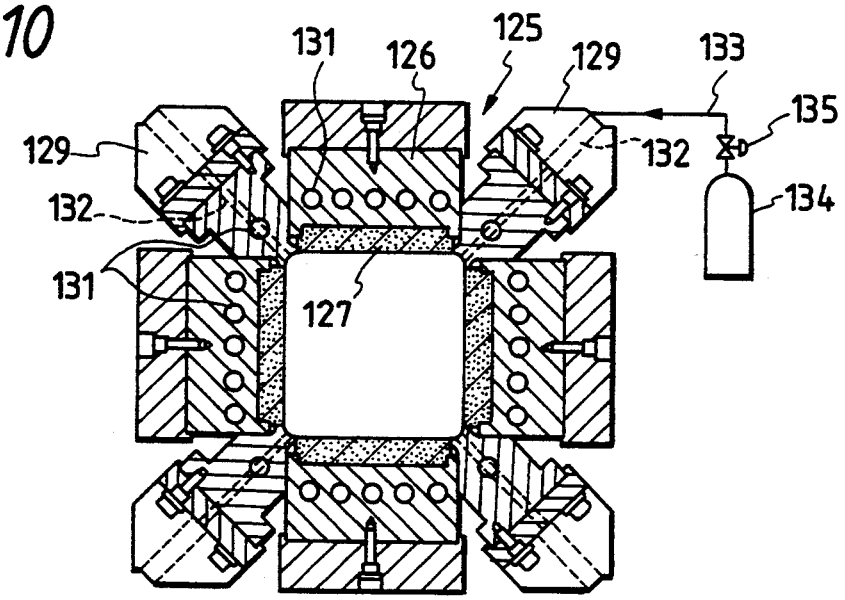
FIG. 10 is a detail front view of a second mold disposed next to the first mold shown in FIG. 1.

As shown in FIG. 10, the second mold 125 is made up of four side-wall blocks 126 each holding a plate of graphite 127 and corner blocks 129 interposed between the adjoining side-wall blocks 126. The side-wall blocks 126 and corner blocks 129 are all made of steel and fastened to a holding frame by the same means as In the second preferred embodiment. Cooling water passages 131 are provided in the side-wall blocks 126 and corner blocks 129. Each corner block 129 has a nitrogen gas intake port 132 that passes there-through at right angles with the cooling water passage 131. A nitrogen gas supply pipe 133 is connected to the inlet of the nitrogen gas inlet port 132. The nitrogen gas supply pipe 133 is connected to a nitrogen gas cylinder 134 through a pressure regulating valve 135. With its pressure reduced to about 5 to 6 kgf/cm$^2$ above atmospheric by the pressure regulating valve 135, the high-pressure nitrogen gas is supplied from the nitrogen gas cylinder 134 to the nitrogen gas intake port 132.

When pressurized nitrogen gas is supplied from the nitrogen gas cylinder 134 to the corner blocks 129 in the mold joint sealing mechanism just described, part of the gas flows to the first mold 57 and another part flows to the second mold 125, thus flowing into a gap g between the inner wall surface of the molds and the solidified shell S. Because the pressure of the nitrogen gas is higher than atmospheric, no air flows into the gap g. The nitrogen gas consumed by dissolution into the cast section C to form a solid solution or flowing outside through the inlet of the first mold 57 or the outlet of the second mold 125 is automatically made up from the nitrogen gas cylinder 134.

Figure 11:
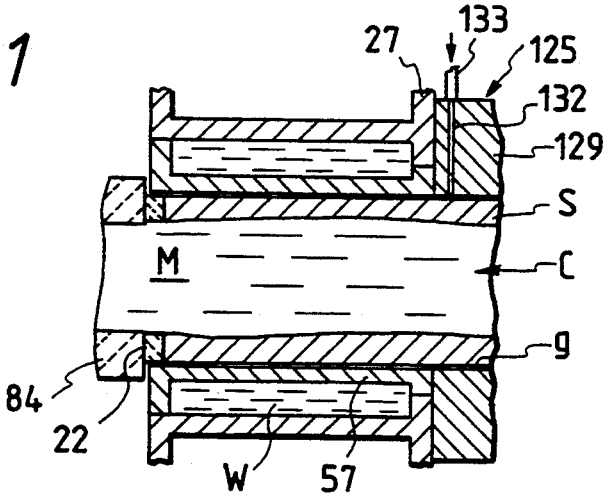
FIG. 11 is a cross-sectional view showing a first mold and surrounding mechanisms of another continuous square billet caster embodying the principle of this invention.

FIG. 11 shows a simplified modification of the sealing mechanism between the first mold 57 and second mold 125 shown in FIG. 9. The simplified sealing mechanism differs from the one shown in FIG. 9 in that it has no cut-off space. That is, the exit end surface of the first mold 57 and the entry end surface of the second mold 125 are in direct contact with each other, with no annular gasket inserted therebetween. A nitrogen gas intake port 132 is provided in each corner block 129 of the second mold 125, and the nitrogen gas supply pipe 133 is connected to the inlet of the nitrogen gas intake port 132. Because the joint between the first mold 57 and second mold 125 is not completely cut off from the atmosphere, the pressure of the nitrogen gas supplied there is set at a level of about 6 to 10 kgf/cm$^2$ above atmospheric, which is higher than in the case of the sealing mechanism shown in FIG. 9.

Now several partial modifications of the sealing mechanism provided at the entry end of the mold will be described.

Figure 12:
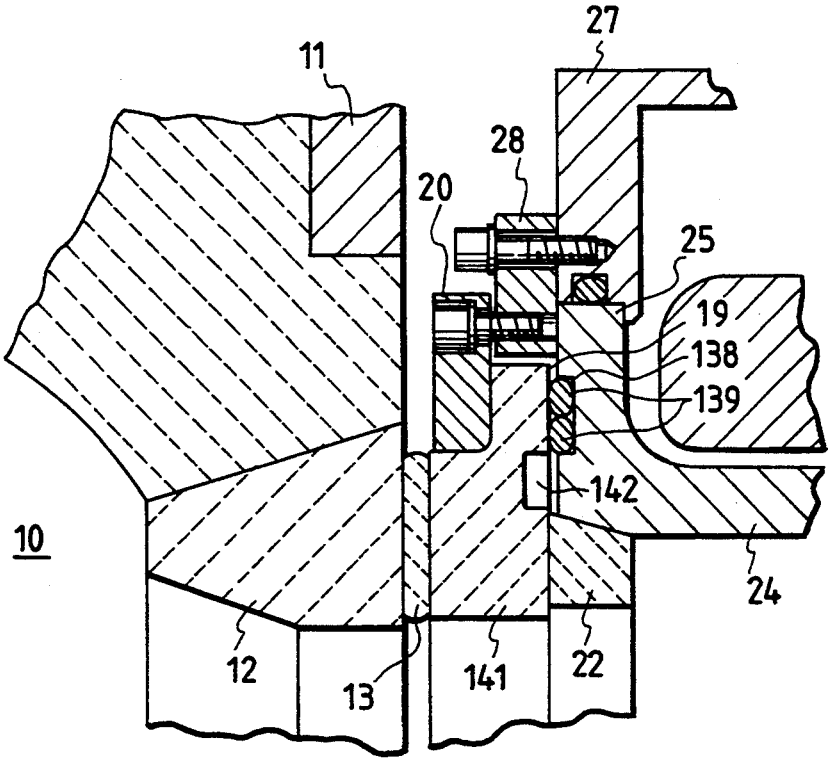
FIG. 12 is a cross-sectional view of a partly modified sealing mechanism disposed between a tundish and a mold.

In a modified embodiment shown in FIG. 12, two annular gaskets 139 are radially doubly inserted in an annular gasket groove 138 cut in the flange 25 of the mold 24. The double sealing mechanism, with the two annular gaskets 139, prevents air infiltration more effectively- A circumferential groove 142 concentric with the inner surface of an intermediate ring 141 is cut in the exit end surface thereof. The circumferential groove 142 is on the inside of the annular gasket groove 138. The heat flowing from the inside of the intermediate ring 141 contacting the molten metal M to the outside thereof makes a detour round the circumferential groove 142. This keeps the temperature increase of the annular gasket 139 moderate, thereby avoiding the overheating thereof.

Figure 13:
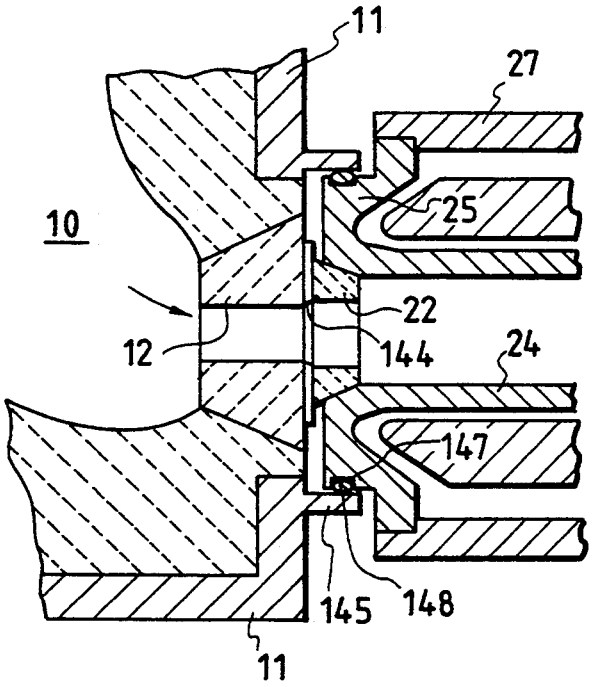
FIG. 13 is a vertical cross-sectional view of another partly modified sealing mechanism disposed between a tundish and a mold.

FIG. 13 shows a modified embodiment in which an annular gasket 148 is inserted between the tundish 10 and the mold 24. This sealing mechanism is used with smaller continuous casters. The tundish 10 and mold 24 are connected by only a tundish nozzle 12, break ring 22 and a heat-resistant gasket 144. The annular gasket 148 is inserted between the tundish 10 and mold 24, which are not separated very much by the few connecting members. An annular projection 145 is formed on the steel shell 11 at the front of the tundish 10. An annular gasket groove 147 is cut in the outer circumferential surface of the flange 25 of the mold 24, with the annular gasket 148 inserted therein. The annular gasket 148 fits in the annular projection 145. While the heat-resistant gasket 144 is tack welded to the front of the tundish nozzle 12, the break ring 22 is inserted in the inlet of the mold 24. The figure shows the condition in which the mold 24 is fitted to the tundish 10 prior to casting. In assembling, the annular projection 145 assists in the positioning (aligning) of the mold 24. Mounted on the outer circumferential surface of the flange 25, not on the end surface of the mold 24, the annular gasket 148 does not come off before the assembling of the tundish 10 and mold 24 is complete. Furthermore, the annular gasket 148 thus mounted absorbs dimensional errors of the connecting members and differences in tie-in dimensions and changes in contact surface pressures resulting from thermal expansion or other causes.

Being made of zircon or other refractories, the intermediate ring 18 itself, shown in FIG. 18, has a high degree of permeability. Also, the pressure inside the mold 24 becomes negative, or lower than atmospheric, when the cast section is withdrawn, as mentioned previously. As such, air is sucked inside the intermediate ring 18 through the pores therein.

Figure 14:
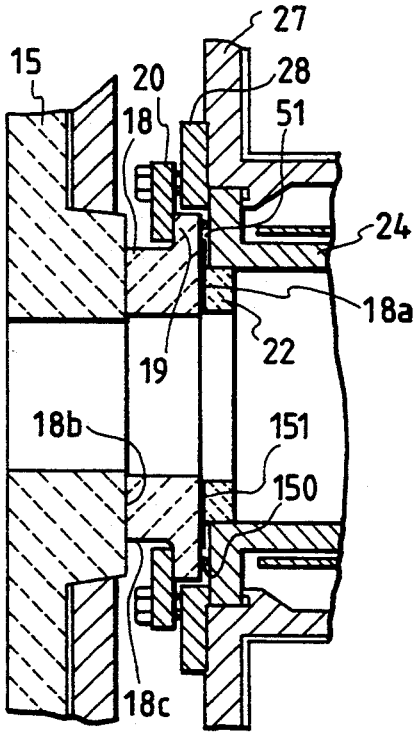
FIG. 14 is a vertical cross-sectional view of an in-ten mediate ring partly covered with a sealing material.

FIG. 14 shows a means to prevent the inflow of air into the mold 24 by covering a part of the intermediate ring 18. An annular stainless steel foil 151 is bonded to the mold-side end surface 18*a* of the intermediate ring 18 inside an annular gasket 150 stainless steel foil 151 is 50 μm thick. To prevent the overheating of the annular gasket 150 by the heat transmitted from the stainless steel foil 151, the outside diameter of the annular stainless steel foil 151 is smaller than the inside diameter of the annular gasket 150. This sealing means is used where air infiltration from the outer circumferential surface 18c is limited by the highly airtight joint between the sliding gate 15 and the tundish-side end surface 18b of the intermediate ring 18 and the thick intermediate ring 18 proper. The annular stain-less steel foil 151 prevents the infiltration of air from a relatively thin part of the intermediate ring 18 proper into a cut-off space 51 sealed by the annular gasket 150.

Figure 15:
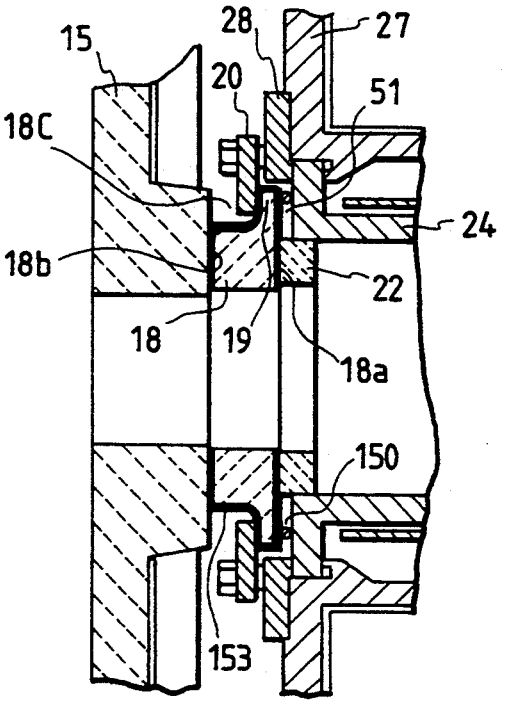
FIG. 15 is a vertical cross-sectional view of an intermediate ring covered with a sealing material.

FIG. 15 shows another embodiment that prevents the in-filtration of air into the mold 24 by covering the outer surface of the intermediate ring 18. The mold-side end surface 18a, tundish-side end surface 18b and outer circumferential surface 18c of the intermediate ring 18 are covered with a stainless steel foil 153. This sealing means is used where the intermediate ring 18 proper has a high degree of permeability and the annular gasket 150 is not exposed to temperatures exceeding the withstandable limit. When the annular gasket 150 seals close to the outer periphery of the flange 19 of the intermediate ring 18, the tundish-side end surface 18b and the outer circumferential surface 18c of the intermediate ring 18 may be covered with the stainless steel foil 153.

Figure 16:
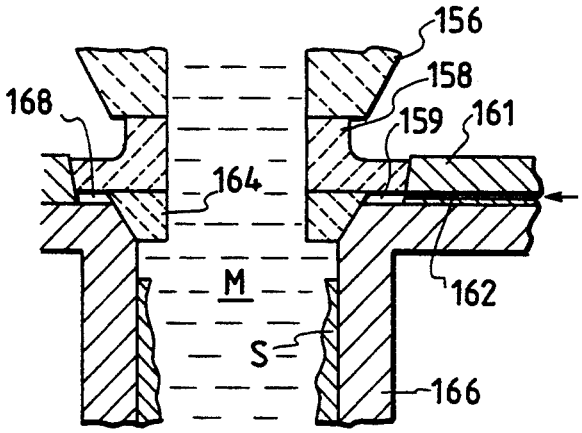
FIG. 16 is a vertical cross-sectional view of another partly modified sealing mechanism of a vertical continuous caster.

While the molds in all embodiments described so far are horizontally positioned, the one shown in FIG. 1 is vertically positioned. While the inner surface of the outer frame 161 of an intermediate ring 158 is held in close contact with the outer surface of the flange 159 thereof, the bottom surface of the outer frame 161 of the intermediate ring 158 is held in close contact with the entry end surface of a mold 166. An annular space 168, not sealed with a gasket 99 etc., is provided between the flange 159 of the intermediate ring 158 and the entry end surface of the mold 166. A nitrogen gas supply port 162 provided in the outer frame 161 Of the intermediate ring 158 communicates with the annular space 168. As in the preferred embodiments described previously, nitrogen gas whose pressure is controlled to about 6 to 10 kgf/cm$^2$ is supplied into the annular space 168 to prevent the infiltration of air into the mold 166. FIG. 16 shows the condition immediately after the departure of the solidified shell S from the end surface of the break ring 164 as a result of the intermittent withdrawal of the cast section.

Table 1 shows the results of casting 170 mm diameter round billets of various types of steels under various casting conditions on the horizontal continuous caster shown in FIG. 5. The cast sections were intermittently withdrawn at intervals of 0.5 second, with an oscillating amplitude of 15 mm, and with a mean withdrawal speed of 1.8 m/min.

As is obvious from Table 1, the number of blowholes formed by the continuous casting method of this invention is much smaller, being under 3.6%, than the number with the conventional methods- The continuous casting method of this invention did not form more than ten blowholes in each 500 cm$^2$. The blowholes as few as this do not need to be removed from the cast section.

TABLE 1-1

| | | Entry Side of Mold | | | | | | |
|---|---|---|---|---|---|---|---|---|
| | | | | With Cut-off Space | | | | |
| | Type of | Without Cut-off Space | | Gas supply to the first cut-off space or pressure reduction | | | Gas supply to the second cut-off space | |
| No. | Cast Steel | Gas | l/min | Gas | l/min | Prs. Red. Torr | Gas | l/min |
| 1 | SUS304 | $N_2$ | 600 | — | | — | — | |
| 2 | SUS304 | — | | $N_2$ | 100 | — | — | |
| 3 | SUS316 | — | | $N_2$ | 400 | — | — | |
| 4 | C Steel | — | | $N_2$ | 300 | — | — | |
| 5 | SUS304 | — | | C | 400 | — | — | |
| 6 | SUS321 | — | | $NH_3$ | 300 | — | $N_2$ | 300 |
| 7 | SUS304 | — | | — | | Prs. Red. 50 | $N_2$ | 400 |
| 8 | SUS304 | — | | — | | Prs. Red. 160 | CO | 300 |
| 9 | SUS304 | — | | — | | — | — | |
| 10 | SUS304 | — | | — | | — | — | |
| 11 | SUS304 | $N_2$ | 300 | — | | — | — | |
| 12 | C Steel | $N_2$ | 600 | — | | — | — | |
| 13 | SUS304 | — | | $N_2$ | 300 | — | — | |
| 14 | SUS304 | — | | — | | — | $N_2$ | 300 |
| 15 | SUS304 | — | | $N_2$ | 100 | — | $N_2$ | 150 |
| 16 | SUS304 | — | | — | | Prs. Red. 90 | — | |
| 17 | SUS304 | — | | — | | Prs. Red. 200 | — | |
| 18 | SUS430 | — | | — | | Prs. Red. 30 | $N_2$ | 300 |
| 19 | SUS304 | — | | — | | Prs. Red. 360 | $NH_3$ | 300 |
| 20 | SUS304 | — | | — | | — | — | |
| 21 | C Steel | — | | Ar | 200 | — | — | |
| 22 | SUS304 | — | | Ar | 200 | — | Ar | 110 |
| 23 | SUS304 | — | | — | | — | — | |
| 24 | SUS304 | — | | Ar | 200 | — | — | |
| 25 | SUS304 | — | | Ar | 200 | — | Ar | 110 |

TABLE 1-2

| | Exit Side of Mold | | | | | |
|---|---|---|---|---|---|---|
| | Without Cut-off Space | | With Cut-off Space | | Number of Blowholes in Cast Section | |
| No. | Gas | l/min | Gas | l/min | (in 500 cm$^2$) | Remarks |
| 1 | — | | — | | 26.9 | Method |
| 2 | — | | — | | 19.1 | of |
| 3 | — | | — | | 16.7 | This |
| 4 | — | | — | | 23.9 | Invention |
| 5 | — | | — | | 21.8 | |
| 6 | — | | — | | 21.3 | |
| 7 | — | | — | | 14.1 | |

TABLE 1-2-continued

| No. | Exit Side of Mold: Without Cut-off Space Gas | Without Cut-off Space l/min | With Cut-off Space Gas | With Cut-off Space l/min | Number of Blowholes in Cast Section (in 500 $cm^2$) | Remarks |
|---|---|---|---|---|---|---|
| 8 | — | | — | | 18.8 | |
| 9 | $N_2$ | 600 | — | | 21.1 | |
| 10 | — | | $N_2$ | 200 | 19.2 | |
| 11 | $N_2$ | 400 | — | | 1.3 | |
| 12 | $N_2$ | 500 | — | | 0.8 | |
| 13 | — | | $N_2$ | 200 | 0.18 | |
| 14 | — | | $NH_3$ | 300 | 0.12 | |
| 15 | — | | $N_2$ | 100 | 0.10 | |
| 16 | — | | $N_2$ | 300 | 0.08 | |
| 17 | — | | $NH_3$ | 400 | 0.10 | |
| 18 | — | | CO | 200 | 0.06 | |
| 19 | — | | $N_2$ | 200 | 0.07 | |
| 20 | — | | — | | 265.1 | Conven- |
| 21 | — | | — | | 330.0 | tional |
| 22 | — | | — | | 410.0 | Method |
| 23 | — | | — | | 913.3 | Compared |
| 24 | — | | Ar | 150 | 926.5 | |
| 25 | — | | Ar | 150 | 1225.1 | |

I claim:

1. A method of continuous casting, comprising the steps of:

continuously supplying molten metal from a tundish to a cooled mold, the mold having an inlet and an outlet, and the molten metal being supplied through a break ring contacting the inlet of the mold on a contact area;

forming a cast section by continuously cooling the molten metal in the mold that is in direct contact with the mold and starting solidification of the molten metal below the surface thereof;

intermittently withdrawing the cast section relative to the mold through the outlet thereof;

providing a cut-off space next to the inlet of the mold that is cut off from the inside of the mold by the contact area between the break ring and the inlet of the mold, bounded along a closed curve at a diameter larger than the maximum diameter of the contact area between the break ring and the inlet of the mold, and cut off from the atmosphere; and constantly supplying a sealing gas at a pressure higher than atmospheric pressure and lower than the ferrostatic pressure of the molten metal that is adjacent the break ring into the cut-off space, the sealing gas being soluble in the molten metal.

2. A method of continuous casting, comprising the steps of:

continuously supplying molten metal from a tundish to a cooled mold, the mold having an inlet and an outlet, and the molten metal being supplied through a break ring contacting the inlet of the mold on a contact area;

forming a cast section by continuously cooling the molten metal in the mold that is in direct contact with the mold and starting solidification of the molten metal below the surface thereof;

intermittently withdrawing the cast section relative to the mold through the outlet thereof;

providing a first cut-off space next to the inlet of the mold that is cut off from the inside of the mold by the contact area between the break ring and the inlet of the mold and that is bounded along a closed curve at a diameter larger than the maximum diameter of the contact area between the break ring and the inlet of the mold, and a second cut-off space that has the first cut-off space inside thereof, that is sealed from the first cut-off space, and that is cut off from the atmosphere;

maintaining the pressure in the first cut-off space below atmospheric pressure; and constantly supplying a sealing gas at a pressure higher than atmospheric pressure into the second cut-off space, the sealing gas being soluble in the molten metal.

3. A method of continuous casting, comprising the steps of:

continuously supplying molten metal from a tundish to a cooled mold, the mold having an inlet and an outlet, and the molten metal being supplied through a break ring contacting the inlet of the mold on a contact area, the contact area between the break ring and the inlet of the mold cutting off a space around the mold inlet from the inside of the mold;

forming a cast section by continuously cooling the molten metal in the mold that is indirect contact with the mold and starting solidification of the molten metal below the surface thereof;

intermittently withdrawing the cast section relative to the mold through the outlet thereof;

providing a cut-off space adjacent the outlet of the mold that is bounded along a closed curve at a diameter larger than the inside diameter of the mold and that is cut off from the atmosphere; and constantly supplying a sealing gas at a pressure higher than atmospheric pressure into the cut-off space adjacent the outlet of the mold, the sealing gas being soluble in the molten metal.

4. A method of continuous casting, comprising the steps of:

continuously supplying molten metal from a tundish to a cooled mold, the mold having an inlet and an outlet, and the molten metal being supplied through a break ring contacting the inlet of the mold on a contact area;

forming a cast section by continuously cooling the molten metal in the mold that is in direct contact with the mold and starting solidification of the molten metal below the surface thereof;

intermittently withdrawing the cast section relative to the mold through the outlet thereof;

providing a first cut-off space next to the inlet of the mold that is cut off from the inside of the mold by the contact area between the break ring and the inlet of the mold, bounded along a closed curve at a diameter larger than the maximum diameter of the contact area between the break ring and the inlet of the mold, and cut off from the atmosphere;

providing a second cut-off space adjacent the outlet of the mold that is bounded along a closed curve at a diameter larger than the inside diameter of the mold and that is cut off from the atmosphere;

constantly supplying a sealing gas to the first cutoff space next to the inlet at a pressure higher than atmospheric pressure and lower than the ferrostatic pressure of the molten metal that is adjacent the break ring, the sealing gas being soluble in the molten metal; and constantly supplying a sealing gas at a pressure higher than atmospheric pressure into the second cut-off space adjacent the outlet of the mold, the sealing gas being soluble in the molten metal.

5. A method of continuous casting, comprising the steps of:

continuously supplying molten metal from a tundish to a cooled mold, the mold having an inlet and an outlet, and the molten metal being supplied through a break ring contacting the inlet of the mold on a contact area;

forming a cast section by continuously cooling the molten metal in the mold that is in direct contact with the mold and starting solidification of the molten metal below the surface thereof;

intermittently withdrawing the cast section relative to the mold through the outlet thereof;

providing a first cut-off space next to the inlet of the mold that is cut off from the inside of the mold by the contact area between the break ring and the inlet of the mold, bounded along a closed curve at a diameter larger than the maximum diameter of the contact area between the break ring and the inlet of the mold, and cut off from the atmosphere;

providing a second cut-off space adjacent the outlet of the mold that is bounded along a closed curve at a diameter larger than the inside diameter of the mold and that is cut off from the atmosphere;

maintaining the pressure in the first cut-off space next to the inlet of the mold below atmospheric pressure and constantly supplying a sealing gas at a pressure higher than atmospheric pressure into the second cut-off space adjacent the outlet of the mold, the sealing gas being soluble in the molten metal.

6. A method of continuous casting, comprising the steps of:

continuously supplying molten metal from a tundish to a cooled mold, the mold having an inlet and an outlet, and the molten metal being supplied through a break ring contacting the inlet of the mold on a contact area;

forming a cast section by continuously cooling the molten metal in the mold that is in direct contact with the mold and starting solidification of the molten metal below the surface thereof;

intermittently withdrawing the cast section relative to the mold through the outlet thereof;

providing a first cut-off space next to the inlet of the mold that is cut off from the inside of the mold by the contact area between the break ring and the inlet of the mold and that is bounded along a closed curve at a diameter larger than the maximum diameter of the contact area between the break ring and the inlet of the mold, and a second cut-off space that has the first cut-off space inside thereof, that is sealed from the first cut-off space, and that is cut off from the atmosphere;

maintaining the pressure in the first cut-off space below atmospheric pressure;

constantly supplying a sealing gas at a pressure higher than atmospheric pressure into the second cut-off space, the sealing gas being soluble in the molten metal;

providing a third cut-off space adjacent the outlet of the mold that is bounded along a closed curve at a diameter larger than the inside diameter of the mold and that is cut off from the atmosphere; and constantly supplying a sealing gas at a pressure higher than atmospheric pressure into the third cut-off space adjacent the outlet of the mold, the sealing gas being soluble in the molten metal.

7. The method of continuous casting of one of claims 1, 2, 3, 4, 5 and 6, wherein the sealing gas is nitrogen.

* * * * *